US008249496B2

(12) United States Patent
Matsutani

(10) Patent No.: US 8,249,496 B2
(45) Date of Patent: Aug. 21, 2012

(54) BROADCAST FREQUENCY DETECTION DEVICE

(75) Inventor: Atsushi Matsutani, Shinagawa-ku (JP)

(73) Assignee: Sony Corporation, Tokyo (JP)

( * ) Notice: Subject to any disclaimer, the term of this patent is extended or adjusted under 35 U.S.C. 154(b) by 683 days.

(21) Appl. No.: 10/586,733

(22) PCT Filed: Feb. 3, 2005

(86) PCT No.: PCT/JP2005/001978

§ 371 (c)(1),
(2), (4) Date: Jul. 21, 2006

(87) PCT Pub. No.: WO2005/076506

PCT Pub. Date: Aug. 18, 2005

(65) Prior Publication Data

US 2008/0233909 A1 Sep. 25, 2008

(30) Foreign Application Priority Data

Feb. 10, 2004 (JP) ..... 2004-033688

(51) Int. Cl.
*H04H 20/71* (2008.01)

(52) U.S. Cl. ..... 455/3.01; 725/44; 725/39

(58) Field of Classification Search ..... 455/3.01–3.06; 725/39, 44–53

See application file for complete search history.

(56) References Cited

U.S. PATENT DOCUMENTS 6,636,853 B1 * 10/2003 Stephens, Jr. ..... 1/1
6,662,231 B1 * 12/2003 Drosset et al. ..... 709/229
6,928,262 B1 * 8/2005 Kanemitsu ..... 455/3.06
8,112,504 B2 * 2/2012 Logan et al. ..... 709/219
2002/0193066 A1 * 12/2002 Connelly ..... 455/2.01
2006/0008256 A1 * 1/2006 Khedouri et al. ..... 386/124

FOREIGN PATENT DOCUMENTS

| | | | |
|---|---|---|---|
| JP | 9-171504 | | 6/1997 |
| JP | 10-269752 | | 10/1998 |
| JP | 2000341593 A | * | 12/2000 |
| JP | 2002-108907 | | 4/2002 |
| JP | 2002-208900 | * | 7/2002 |
| JP | 2002-342351 | * | 11/2002 |
| JP | 2003-6511 | | 1/2003 |
| JP | 2004-80275 | | 3/2004 |
| JP | 2004-288330 | | 10/2004 |

OTHER PUBLICATIONS

"Media Click, FM Taju Hoso o Riyo shita Joho Haishin Service—FM Hoso no Kininatta kyoku no Gakkyoku Joho o Kiroku Kano", AV Watch, Impress Corp., 2003.

* cited by examiner

*Primary Examiner* — Nay A Maung
*Assistant Examiner* — Angelica Perez
(74) *Attorney, Agent, or Firm* — Oblon, Spivak, McClelland, Maier & Neustadt, L.L.P.

(57) ABSTRACT

By detecting the broadcast frequency of a musical composition in radio broadcasting based on on-air information and now-on-air information being broadcast contents information, the broadcast frequency of each musical composition can be displayed on a display 26 without receiving and outputting radio broadcasting. Thereby, the user can recognize that which musical composition is frequently broadcasted. Thus, even if the user does not listen to the musical composition broadcasted in the radio broadcasting, the broadcast frequency of the musical composition can be shown to the above user.

14 Claims, 12 Drawing Sheets

RANKING OF NUMBER OF TIMES OF BROADCASTING (WEEKLY)

| RANK | NUMBER OF TIMES OF BROADCASTING | TITLE OF MUSICAL COMPOSITION | ARTIST |
|---|---|---|---|
| ① | 23 | TO ME | AMI HAMAZAKI |
| ② | 20 | DORA DORA DORA | NAX |
| ③ | 13 | PILLOW - CHORUS | SEITARO KOMIYAMA |
| ④ | 10 | TRABELING | HIKARI UTADA |
| ⑤ | 8 | THE PLACE IN THE SUN | MESEA |
| ⑥ | 5 | STAR GAYSER | SPOTZ |
| ⑦ | 4 | SO IN VEIN | CHAMESTRY |
| ⑧ | 2 | ANDROMADA | EIKO |
| ⑨ | 1 | PALLADE | AYANO KAJI |
| ⑨ | 1 | TURN IT ON | EGLY DOCKLING |

50 BROADCAST FREQUENCY DISPLAY SCREEN

TB1 TABLE OF PROGRAM BEING BROADCASTED

| STATION NAME | PROGRAM TITLE | BROADCASTER (DJ) | TITLE OF MUSICAL COMPOSITION | ARTIST | GENRE |
|---|---|---|---|---|---|
| FM NAKAHARA | MY MY RADIO | TOTAL MASUMOTO | OVER THE STARRY SKY | PRIM-LOOKING FACE | POP |

TB2 TABLE OF ALREADY-BROADCASTED MUSICAL COMPOSITIONS

| STATION NAME | BROADCASTING TIME | TITLE OF MUSICAL COMPOSITION | ARTIST | GENRE |
|---|---|---|---|---|
| ⋮ | ⋮ | ⋮ | ⋮ | ⋮ |
| FM NAKAHARA | DEC 1 20:05 | DORA DORA DORA | NAX | ROCK |
| FM NAKAHARA | DEC 1 20:09 | BLUE TRIANGLE | DJC | ROCK |
| FM NAKAHARA | DEC 1 20:25 | ON THE HILL BLOOMING ROSES | TIGER ASH | ROCK |
| FM NAKAHARA | DEC 1 20:33 | NO. 2 | KAZUYUKI AKIHARA | POP |
| FM NAKAHARA | DEC 1 20:37 | TO ME | AMI HAMAZAKI | POP |
| FM NAKAHARA | DEC 1 20:41 | LED WINE '89 | CL NETWORK | POP |
| FM NAKAHARA | DEC 1 20:50 | PILLOW - CHORUS | SEITARO KOMIYAMA | POP |
| FM NAKAHARA | DEC 1 20:55 | MANIC-DEPRESSION IN WINTER | WALKING EN CELL | ROCK |

TB3 TABLE OF ALREADY-BROADCASTED PROGRAMS

| STATION NAME | BROADCASTING TIME PERIOD | PROGRAM TITLE | BROADCASTER (DJ) |
|---|---|---|---|
| ⋮ | ⋮ | ⋮ | ⋮ |
| FM NAKAHARA | DEC 1 19:00-20:00 | WORLD BEAT | SOBAT NIMPULSE |
| FM NAKAHARA | DEC 1 20:00-20:30 | ROCK ON | CHRIS PEPPER |
| FM NAKAHARA | DEC 1 20:30-20:45 | SLOW NIGHT | JOHN KABALA |

FIG. 3

TB1

| STATION NAME | PROGRAM TITLE | BROADCASTER (DJ) | TITLE OF MUSICAL COMPOSITION | ARTIST | GENRE |
|---|---|---|---|---|---|
| FM NAKAHARA | MY MY RADIO | TOTAL MASUMOTO | OVER THE STARRY SKY | PRIM-LOOKING FACE | POP |

THIS IS UPDATED IF THE MUSICAL COMPOSITION IS SWITCHED.

TB1

| STATION NAME | PROGRAM TITLE | BROADCASTER (DJ) | TITLE OF MUSICAL COMPOSITION | ARTIST | GENRE |
|---|---|---|---|---|---|
| FM NAKAHARA | MY MY RADIO | TOTAL MASUMOTO | FLOWER OF THE MOON | RIKA NAKAJIMA | POP |

FIG. 4

TB2

| STATION NAME | BROADCASTING TIME | TITLE OF MUSICAL COMPOSITION | ARTIST | GENRE |
|---|---|---|---|---|
| ⋮ | ⋮ | ⋮ | ⋮ | ⋮ |
| FM NAKAHARA | DEC 1 20:05 | DORA DORA DORA | NAX | ROCK |
| FM NAKAHARA | DEC 1 20:09 | BLUE TRIANGLE | DJC | ROCK |
| FM NAKAHARA | DEC 1 20:25 | ON THE HILL BLOOMING ROSES | TIGER ASH | ROCK |
| FM NAKAHARA | DEC 1 20:33 | NO. 2 | KAZUYUKI AKIHARA | POP |
| FM NAKAHARA | DEC 1 20:37 | TO ME | AMI HAMAZAKI | POP |
| FM NAKAHARA | DEC 1 20:41 | LED WINE '89 | CL NETWORK | POP |
| FM NAKAHARA | DEC 1 20:50 | PILLOW - CHORUS | SEITARO KOMIYAMA | POP |
| FM NAKAHARA | DEC 1 20:55 | MANIC-DEPRESSION IN WINTER | WALKING EN CELL | ROCK |
| FM NAKAHARA | DEC 1 20:59 | OVER THE STARRY SKY | PRIM-LOOKING FACE | ROCK |

THIS IS ADDED AFTER A PREDETERMINED TIME PASSED FROM WHEN ITS BROADCASTING FINISHED.

FIG. 5

TB3

| STATION NAME | BROADCASTING TIME PERIOD | PROGRAM TITLE | BROADCASTER (DJ) |
|---|---|---|---|
| ⋮ | ⋮ | ⋮ | ⋮ |
| FM NAKAHARA | DEC 1 19:00-20:00 | WORLD BEAT | SOBAT NIMPULSE |
| FM NAKAHARA | DEC 1 20:00-20:30 | ROCK ON | CHRIS PEPPER |
| FM NAKAHARA | DEC 1 20:30-20:45 | SLOW NIGHT | JOHN KABALA |
| FM NAKAHARA | DEC 1 20:45-21:30 | MY MY RADIO | TOTAL MASUMOTO |

THIS IS ADDED AFTER A PREDETERMINED TIME PASSED FROM WHEN ITS BROADCASTING FINISHED.

FIG. 6

| STATION NAME | BROADCASTING TIME PERIOD | PROGRAM TITLE | BROADCASTER (DJ) | BROADCASTING TIME | TITLE OF MUSICAL COMPOSITION | ARTIST | GENRE |
|---|---|---|---|---|---|---|---|
| ⋮ | ⋮ | ⋮ | ⋮ | ⋮ | ⋮ | ⋮ | ⋮ |
| FM NAKAHARA | DEC 1 20:00-20:30 | ROCK ON | CHRIS PEPPER | DEC 1 20:05 | DORA DORA DORA | NAX | ROCK |
| FM NAKAHARA | DEC 1 20:00-20:30 | ROCK ON | CHRIS PEPPER | DEC 1 20:09 | BLUE TRIANGLE | DJC | ROCK |
| FM NAKAHARA | DEC 1 20:00-20:30 | ROCK ON | CHRIS PEPPER | DEC 1 20:25 | ON THE HILL BLOOMING ROSES | TIGER ASH | ROCK |
| FM NAKAHARA | DEC 1 20:30-20:45 | SLOW NIGHT | JOHN KABALA | DEC 1 20:33 | NO. 2 | KAZUYUKI AKIHARA | POP |
| FM NAKAHARA | DEC 1 20:30-20:45 | SLOW NIGHT | JOHN KABALA | DEC 1 20:37 | TO ME | AMI HAMAZAKI | POP |
| FM NAKAHARA | DEC 1 20:30-20:45 | SLOW NIGHT | JOHN KABALA | DEC 1 20:41 | LED WINE '89 | CL NETWORK | POP |
| ⋮ | ⋮ | ⋮ | ⋮ | ⋮ | ⋮ | ⋮ | ⋮ |

FIG. 7

RANKING OF NUMBER OF TIMES OF BROADCASTING (WEEKLY)

| RANK | NUMBER OF TIMES OF BROADCASTING | TITLE OF MUSICAL COMPOSITION | ARTIST |
|---|---|---|---|
| ① | 23 | TO ME | AMI HAMAZAKI |
| ② | 20 | DORA DORA DORA | NAX |
| ③ | 13 | PILLOW - CHORUS | SEITARO KOMIYAMA |
| ④ | 10 | TRABELING | HIKARI UTADA |
| ⑤ | 8 | THE PLACE IN THE SUN | MESEA |
| ⑥ | 5 | STAR GAYSER | SPOTZ |
| ⑦ | 4 | SO IN VEIN | CHAMESTRY |
| ⑧ | 2 | ANDROMADA | EIKO |
| ⑨ | 1 | PALLADE | AYANO KAJI |
| ⑨ | 1 | TURN IT ON | EGLY DOCKLING |

50 BROADCAST FREQUENCY DISPLAY SCREEN

FIG. 11

BROADCAST FREQUENCY DETECTION DEVICE

TECHNICAL FIELD

The present invention relates to a broadcast frequency detection system, and is suitably applicable when in detecting the broadcast frequency of a broadcast content and showing the above broadcast frequency to the user.

BACKGROUND ART

Heretofore, if the user (for example, the listener of radio broadcasting) recognizes that the same broadcast content (for example, a musical composition) was broadcasted many times when listening to the radio broadcasting, at this time, the user can know that this musical composition is a musical composition frequently broadcasted in radio broadcasting, for the first time.

Then, a method that for example, when the musical composition was broadcasted again, the listener makes a portable terminal store the time of this time, and a predetermined server searches for a database for information concerning the above musical composition and the radio program in that the above musical composition was broadcasted (hereinafter, this is also referred to as broadcast contents information) based on the time and provides this to the above listener has been proposed (for example, see Patent Document 1).

Patent Document 1—Japanese Patent Laid-Open No. 2000-339345.

By the way, heretofore, in order that the listener can know a musical composition that is frequently broadcasted in radio broadcasting, the listener have to be listening to the radio broadcasting when the musical composition is broadcasted.

Therefore, there has been a problem that the listener cannot know musical compositions frequently broadcasted in radio broadcasting by the radio stations and in the time zones that the above listener does not listen.

DISCLOSURE OF INVENTION

Considering the above points, the present invention has been done and is proposing a program search system, a program search method and a program search program that can show the broadcast frequency of a broadcast content to the above user, irrespective of the viewing and the listening of the broadcast content by the above user.

To obviate such problem, according to a broadcast frequency detection system of the present invention, communication means for transmitting request information to request broadcast contents information to a storage device for storing broadcast contents information including the titles of the broadcast contents that will be broadcasted by one or more broadcasting stations, and also receiving the broadcast contents information transmitted from the storage device responding to the above request information, and detection means for detecting broadcast frequency by the broadcast contents in the broadcast contents information received by the communication means are provided.

Further, according to a broadcast frequency detection system of the present invention, a storage medium for storing broadcast contents information including the broadcasting time and date and the titles of the broadcast contents that will be broadcasted by one or more broadcasting stations by the above broadcast contents, receiving means for receiving search condition information to specify at least either one of the broadcasting period, the title and the broadcasting station name of a broadcast program as a search condition, from an external device, search means for searching the storage medium for broadcast contents information corresponding to the search condition, based on the search condition information received by the receiving means, detection means for detecting broadcast frequency by the broadcast contents, in the broadcast contents information that was obtained as the search result by the search means, and transmission means for transmitting information based on the broadcast frequency by the broadcast contents detected by the detection means, to the external device are provided.

By detecting broadcast frequency by broadcast contents based on broadcast contents information concerning the broadcast contents as the above, the broadcast frequency of each broadcast content can be displayed in a predetermined display section, without outputting the video and the sound of the broadcast content. Thereby, the user can recognize that which broadcast content is frequently broadcasted.

Further, according to a broadcast frequency detecting method of the present invention, the communication step of transmitting request information to request broadcast contents information to a storage device for storing broadcast contents information including the titles of the broadcast contents that will be broadcasted by one or more broadcasting stations, and also receiving the broadcast contents information transmitted from the storage device responding to the above request information, and the detection step of detecting broadcast frequency by the broadcast contents in the broadcast contents information received by the communication step are provided.

By detecting broadcast frequency by broadcast contents based on broadcast contents information concerning the broadcast contents as the above, the broadcast frequency of each broadcast content can be displayed in a predetermined display section, without outputting the video and the sound of the broadcast content. Thereby, the user can recognize that which broadcast content is frequently broadcasted.

Further, according to a broadcast frequency detecting program of the present invention, the communication step of transmitting request information to request broadcast contents information to a storage device for storing broadcast contents information including the titles of the broadcast contents that will be broadcasted by one or more broadcasting stations, and also receiving the broadcast contents information transmitted from the storage device responding to the above request information, and the detection step of detecting broadcast frequency by the broadcast contents in the broadcast contents information received in the communication step are executed in an information processing unit.

By detecting broadcast frequency by broadcast contents based on broadcast contents information concerning the broadcast contents as the above, the broadcast frequency of each broadcast content can be displayed in a predetermined display section, without outputting the video and the sound of the broadcast content. Thereby, the user can recognize that which broadcast content is frequently broadcasted.

According to the present invention, by detecting the broadcast frequency of a broadcast content based on broadcast contents information concerning the broadcast content, the broadcast frequency of each broadcast content can be displayed in a predetermined display section, without outputting the video and the sound of the broadcast content. Thereby, the user can recognize that which broadcast content is frequently broadcasted. Thus, a broadcast frequency detection system, a broadcast frequency detecting method and a broadcast frequency detecting program that can show the broadcast frequency of a broadcast content to the above user, irrespective of the viewing and the listening of the broadcast content by the user can be realized.

BRIEF DESCRIPTION OF DRAWINGS

FIG. 3 is a schematic diagram showing the configuration of a broadcast contents information database.

FIG. 4 is a schematic diagram showing the update of broadcast contents information in a table of program being broadcasted.

FIG. 5 is a schematic diagram showing the addition of broadcast contents information in a table of already-broadcasted musical compositions.

FIG. 6 is a schematic diagram showing the addition of broadcast contents information in a table of already-broadcasted programs.

FIG. 7 is a schematic diagram showing the contents of on-air information.

FIG. 11 is a schematic diagram showing a broadcast frequency display screen.

BEST MODE FOR CARRYING OUT THE INVENTION

An embodiment of the present invention will be described in detail with reference to the accompanying drawings.

(1) Configuration of Broadcast Content Information Provision System

Figure 1:
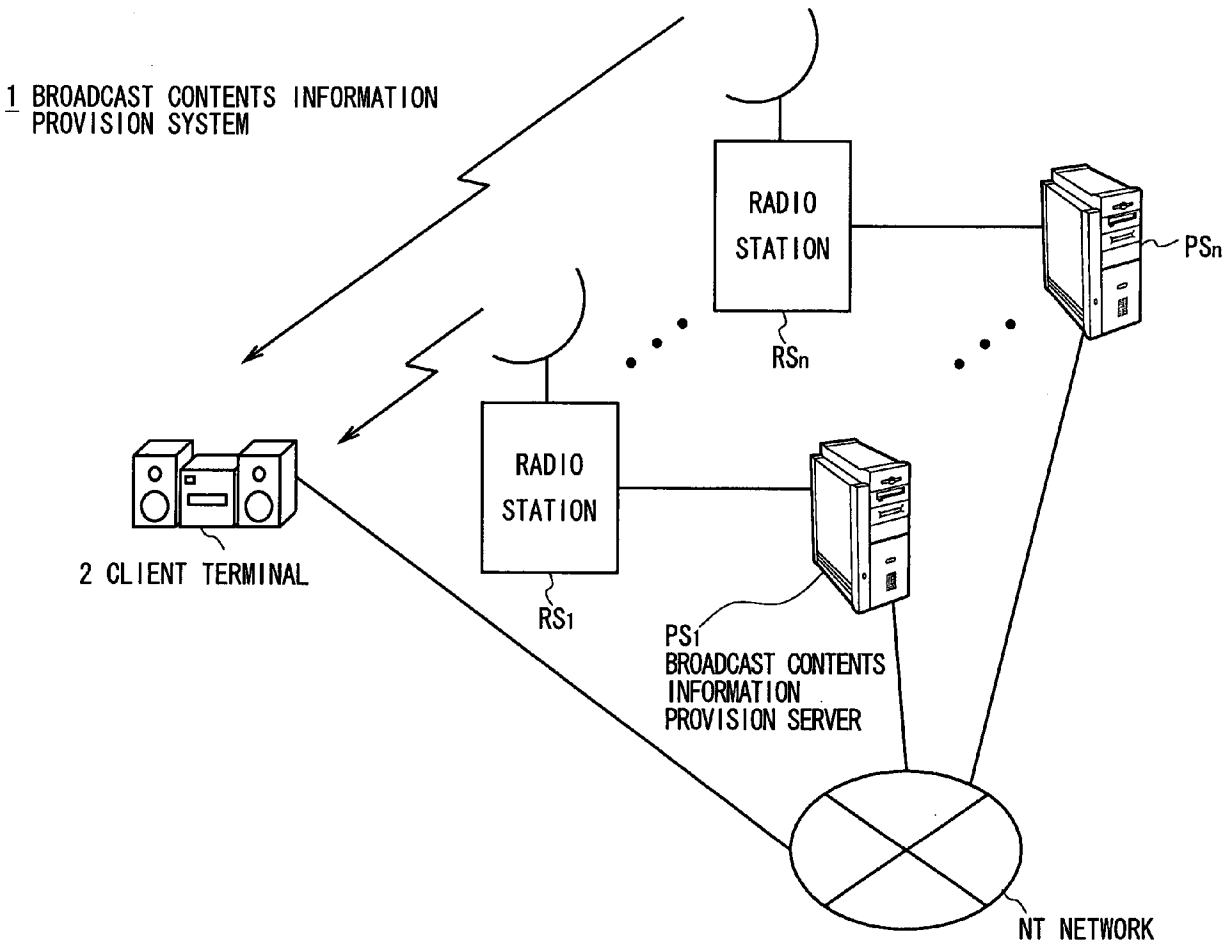
FIG. 1 is a schematic diagram showing the configuration of a broadcast contents information provision system according to this embodiment.

Referring to FIG. 1, the reference numeral 1 shows a broadcast contents information provision system as a whole. A client terminal 2 receives a radio broadcast wave respectively transmitted from one or more radio stations RS ($RS_1$-$RS_n$).

Further, in the radio station RS ($RS_1$-$RS_n$), a broadcast contents information provision server PS ($PS_1$-$PS_n$) which provides broadcast contents information (the contents will be described later) in the own station to the client terminal 2 via a network NT such as the Internet is connected by a leased line respectively. The present broadcasting state (the start and the end of a radio program, the start and the end of a musical composition broadcasted in the radio program) is notified to the above broadcast contents information provision server PS ($PS_1$-$PS_n$).

Then, if accepting an acquisition request of broadcast contents information from the client terminal 2 via the network NT, the broadcast contents information provision server PS ($PS_1$-$PS_n$) transmits the broadcast contents information to the client terminal 2 via the network NT responding to this acquisition request.

(2) Circuit Configuration of Broadcast Content Information Provision Server

Next, the circuit configuration of the broadcast contents information provision server PS ($PS_1$-$PS_n$) will be described. Note that, because the circuit configurations of the broadcast contents information provision servers $PS_1$-$PS_n$ in this embodiment are completely same, here only the circuit configuration of the broadcast contents information provision server $PS_1$ will be described as an example. The description of the broadcast contents information provision servers $PS_2$-$PS_n$ will be omitted.

Figure 2:
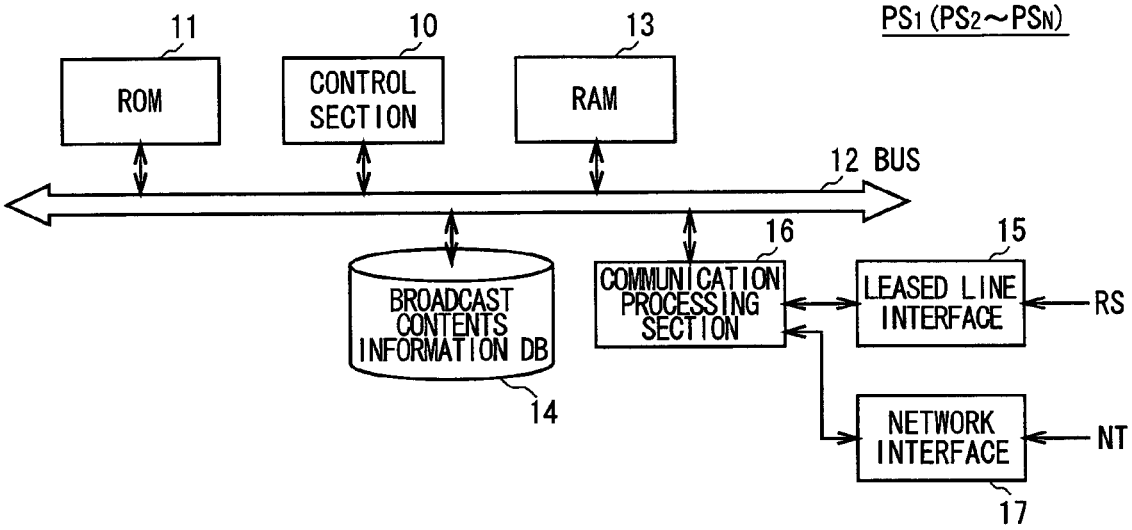
FIG. 2 is a block diagram showing the configuration of a broadcast contents information provision server.

As shown in FIG. 2, in the broadcast contents information provision server $PS_1$, a control section 10 having a central processing unit (CPU) configuration reads out various programs such as a basic program and application programs that have been previously stored in a read only memory (ROM) 11 to a random access memory (RAM) 13 via a bus 12, and controls the overall server according to these various programs, and also executes predetermined operation processing or the like.

This broadcast contents information provision server $PS_1$ is managed by the radio station $RS_1$ connected by the leased line, and broadcast contents information concerning the radio broadcasting broadcasted by the above radio station $RS_1$ is managed by a broadcast contents information database 14.

Here, the configuration of this broadcast contents information database 14 is shown in FIG. 3. The broadcast contents information database 14 is composed of a plurality of tables for managing broadcast contents information (a table of program being broadcasted TB1, a table of already-broadcasted musical compositions TB2 and a table of already-broadcasted programs TB3).

In the table of program being broadcasted TB1, broadcast contents information composed of the station name of the radio station $RS_1$ connected to the broadcast contents information provision server $PS_1$, the title of a radio program being broadcasted now by the above radio station $RS_1$, the title of a musical composition being broadcasted now in the above radio program, the artist of the above musical composition and the genre of the above musical composition has been stored.

That is, in the table of program being broadcasted TB1, only broadcast contents information concerning the radio program and the musical composition being broadcasted now is stored.

In the table of already-broadcasted musical compositions TB2, broadcast contents information composed of the station name of the radio station $RS_1$, the time (the date and the start time) when a musical composition was broadcasted in a radio program by the above radio station $RS_1$, the title of the above musical composition, the artist of the above musical composition and the genre of the above musical composition has been stored.

That is, in the table of already-broadcasted musical compositions TB2, broadcast contents information concerning the musical compositions that were broadcasted in the radio programs is stored.

And in the table of already-broadcasted programs TB3, broadcast contents information composed of the station name of the radio station $RS_1$, the broadcasting time (the date, the start time and the end time) of a radio program that was broadcasted by the above radio station $RS_1$, the title of the above radio program, and the name of the broadcaster (disk jockey (DJ)) of the above radio program has been stored.

That is, in the table of already-broadcasted programs TB3, broadcast contents information concerning the radio programs that were broadcasted is stored.

Practically, if the present broadcasting state (the start and the end of a radio program, and the start and the end of a musical composition broadcasted in the radio program) is notified from the radio station $RS_1$ sequentially via a leased line interface 15 and a communication processing section 16, as shown in FIG. 4, the control section 10 (FIG. 2) of the broadcast contents information provision server $PS_1$ updates the table of program being broadcasted TB1 in the broadcast contents information database 14, according to the broadcasting state.

Specifically, the broadcast contents information stored in the table of program being broadcasted TB1 is updated to the latest broadcast contents information, at the timing of when a radio program finished and was switched to the next radio program, and a musical composition that had been broadcasted in the radio program was switched to the next musical composition.

Accordingly, in the table of program being broadcasted TB1, almost real-time broadcast contents information matching to the present broadcasting state is stored.

Responding to an acquisition request from the client terminal 2, the control section 10 transmits the real-time broadcast contents information stored in the table of program being broadcasted TB1 (hereinafter, this is referred to as now-on-air information) to the client terminal 2, sequentially via the communication processing section 16 and a network interface 17.

Further, after a predetermined time (for example, a few minutes) passed after the broadcasting of the musical composition being broadcasted in the radio program finished, as shown in FIG. 5, the control section 10 adds broadcast contents information concerning the above musical composition to the table of already-broadcasted musical compositions TB2.

Further, after a predetermined time (for example, a few minutes) passed after the broadcasting of the radio program finished, as shown in FIG. 6, the control section 10 adds broadcast contents information concerning the above radio program to the table of already-broadcasted programs TB3.

Also, by connecting the broadcasting time in the table of already-broadcasted musical compositions TB2 with the broadcasting time in the table of already-broadcasted programs TB3, as shown in FIG. 7, the control section 10 generates broadcast contents information concerning the radio program and the musical composition broadcasted in the above radio program (hereinafter, this is referred to as on-air information).

The on-air information becomes broadcast contents information concerning radio program and a musical composition broadcasted in the above each radio program as the above. Thus, by accumulating the on-air information, this accumulated on-air information becomes list information showing that which musical composition was broadcasted in which radio program.

Responding to an acquisition request from the client terminal 2, the control section 10 transmits this on-air information to the client terminal 2, sequentially via the communication processing section 16 and the network interface 17.

In this manner, the broadcast contents information provision server $PS_1$ stores and manages broadcast contents information concerning radio broadcasting broadcasted by the radio station $RS_1$, and also generates now-on-air information concerning radio broadcasting being broadcasted now, and on-air information concerning radio broadcasting already broadcasted based on the broadcast contents information, and provides this to the above client terminal 2.

Similarly, also the broadcast contents information provision servers $PS_2$-$PS_n$ store and manage the broadcast contents information of radio broadcasting broadcasted by the respectively-corresponding radio stations $RS_2$-$RS_n$, and also provides now-on-air information and on-air information to the client terminal 2.

(3) Circuit Configuration of Client Terminal

Figure 8:
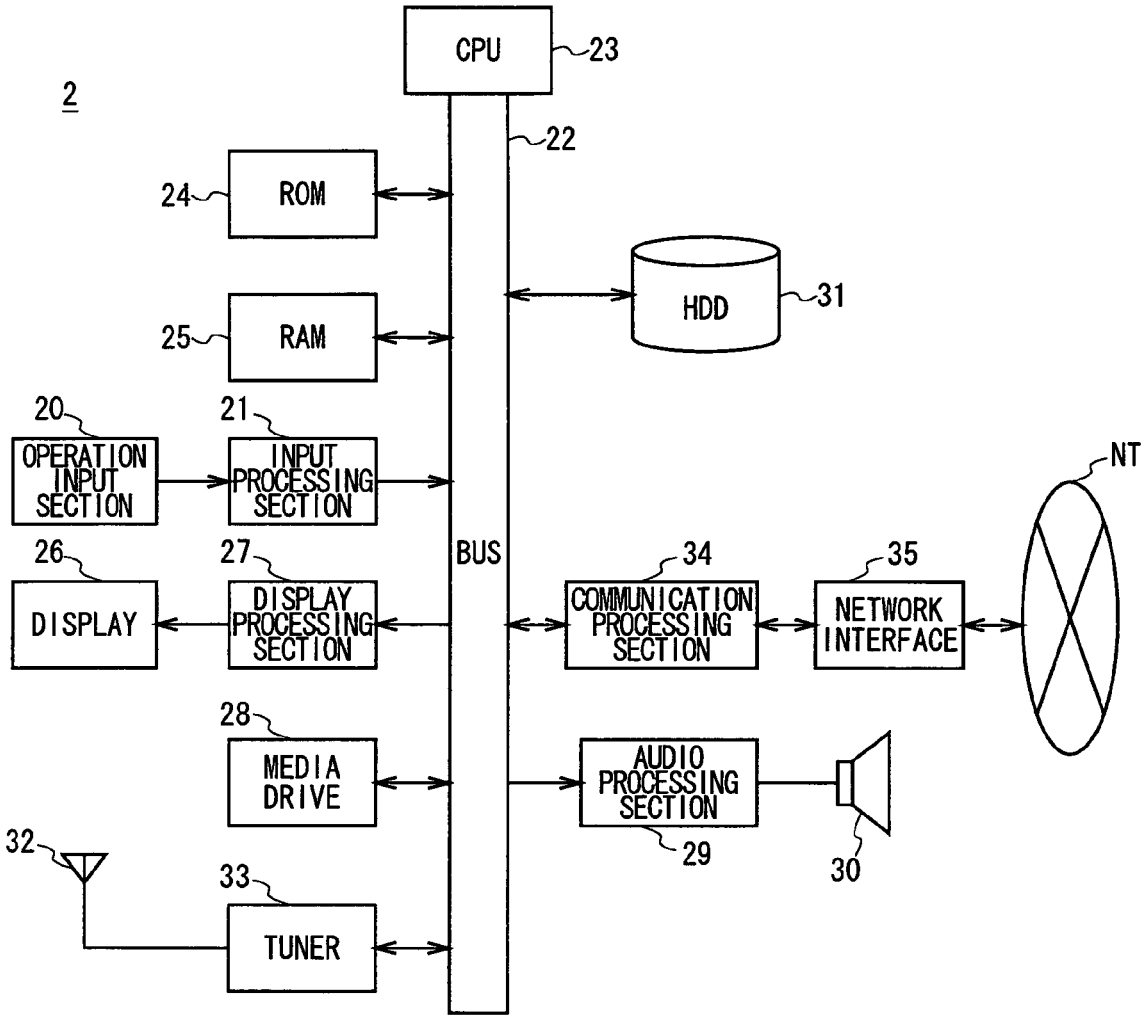
FIG. 8 is a block diagram showing the circuit configuration of a client terminal.

Next, the circuit configuration of the client terminal 2 will be described. As shown in FIG. 8, if an operation input section 20 formed by various operation buttons provided on the surface of the main body of the client terminal 2 and a remote controller (not shown) is operated by the user, the client terminal 2 recognizes this at the operation input section 20, and transmits an operation input signal corresponding to the above operation to an input processing section 21.

The input processing section 21 performs predetermined input processing on the supplied operation input signal to convert the above operation input signal into an operation command, and supplies this to a CPU 23 via a bus 22.

The CPU 23 reads out various programs such as a basic program and application programs previously stored in a ROM 24 to a RAM 25 via the bus 22, and controls the overall client terminal 2 according to these various programs, and also executes predetermined operation processing and various processing corresponding to the operation command supplied from the input processing section 21.

A display 26 is a display device such as a liquid crystal display, and there are a case of directly attached to the surface of the main body and a case of externally provided. If a processing result by the CPU 23 or various video data is supplied via the display processing section 27 as a video signal, an image based on the above video signal is displayed.

The media drive 28 is a drive for reading out and reproducing for example content data recorded in a compact disc (CD), and content data recorded in a Memory Stick® being a flash memory or the like. If the content data is video data, the media drive 28 transmits this to the display processing section 27 via the bus 22. If it is audio data, the media drive 28 transmits this to an audio processing section 29.

The display processing section 27 performs digital-to-analog conversion processing on the video data supplied via the bus 22, and supplies thus obtained video signal to the display 26, so that an image based on the above video signal is displayed on the display 26.

On the other hand, the audio processing section 29 performs digital-to-analog conversion processing on the audio data supplied via the bus 22, and transmits thus obtained audio signal to a two-channel speaker 30, so that a stereo sound based on the above audio signal is emitted from the speaker 30.

Further, the CPU 23 also can store content data in a hard disk drive 31 as a content file, by transmitting the content data read by the media drive 28 to the hard disk drive 31 via the bus 22.

In this connection, also the content file stored in the hard disk drive 31 can be read out from the hard disk drive 31 as content data, and can be outputted from the display 26 and the speaker 30.

An antenna 32 receives radio broadcast waves transmitted from the radio stations RS ($RS_1$-$RS_n$), and transmits them to a tuner 33 being an AM/FM tuner.

The tuner 33 extracts a radio broadcast signal for example, at a frequency corresponding to the radio station $RS_1$ that was specified via the operation input section 20, from the radio broadcast waves received via the antenna 32 under the control of the CPU 23, demodulates it, and outputs thus obtained audio signal from the speaker 30 sequentially via the bus 22 and the audio processing section 29.

Thereby, the user can listen to the program sound of a program broadcasted by the radio station $RS_1$.

Further, the CPU 23 also can access the broadcast contents information provision server PS ($PS_1$-$PS_n$) on a network NT, by connecting the client terminal 2 to the network NT sequentially via a communication processing section 34 and a network interface 35.

Then, as the occasion demands, the CPU 23 transmits request information to request the acquisition of the aforementioned now-on-air information and on-air information to this broadcast contents information provision server PS ($PS_1$-$PS_n$), and also receives the now-on-air information and on-air information transmitted from the above broadcast contents information provision server PS ($PS_1$-$PS_n$) responding to the above request information. Thereby, they can be recorded on the hard disk drive 31.

Furthermore, the client terminal 2 also can access a general service server on the network NT that is not shown in the drawings. The client terminal 2 transmits area information showing an area that the above client terminal 2 is used to the general service server. Thereby, a frequency of radio broadcasting that can be received in the above area, the station name of the radio station RS ($RS_1$-$RS_n$) broadcasting the above radio broadcasting, the address of the broadcast contents information provision server PS ($PS_1$-$PS_n$) that is managed by the above radio station RS ($RS_1$-$RS_n$), and the like can be obtained from the general service server.

The client terminal 2 makes the user select some desired radio stations RS ($RS_1$-$RS_n$), from among thus obtained receivable radio stations RS ($RS_1$-$RS_n$), and records information in that the station names, the frequencies of these selected radio stations RS ($RS_1$-$RS_n$), and the addresses of the broadcast contents information provision servers PS ($PS_1$-$PS_n$) that are managed by the above selected radio stations RS ($RS_1$-$RS_n$) are connected with each other (hereinafter, this is referred to as preset information) on the hard disk drive 31.

Thereby, the CPU 23 of the client terminal 2 tunes the tuner 33 to the frequency of the specified radio station $RS_1$, or accesses the broadcast contents information provision server $PS_1$ managed by the radio station $RS_1$, only by making the user specify for example the station name of the radio station $RS_1$ from this preset information.

(4) Broadcast Frequency Display Function

The client terminal 2 in this embodiment has a broadcast frequency display function to detect the broadcast frequency of a musical composition in radio broadcasting, and show this to the user.

Practically, in the client terminal 2, as this technique to detect the broadcast frequency of a musical composition, if roughly classifying, there are a technique to detect it from on-air information accumulated and managed by the broadcast contents information provision server PS ($PS_1$-$PS_n$), and a technique to detect it from now-on-air information recorded and managed.

Further, among them, in the technique to detect it from on-air information, there are a case where the client terminal 2 detects it by receiving on-air information from the broadcast contents information provision server PS ($PS_1$-$PS_n$), and a case where the client terminal 2 makes the broadcast contents information provision server PS ($PS_1$-$PS_n$) side detect the broadcast frequency of a musical composition from on-air information and receives this.

Broadcast frequency display processing which corresponds to each technique and each case in the broadcast frequency display function will be described.

Figure 9:
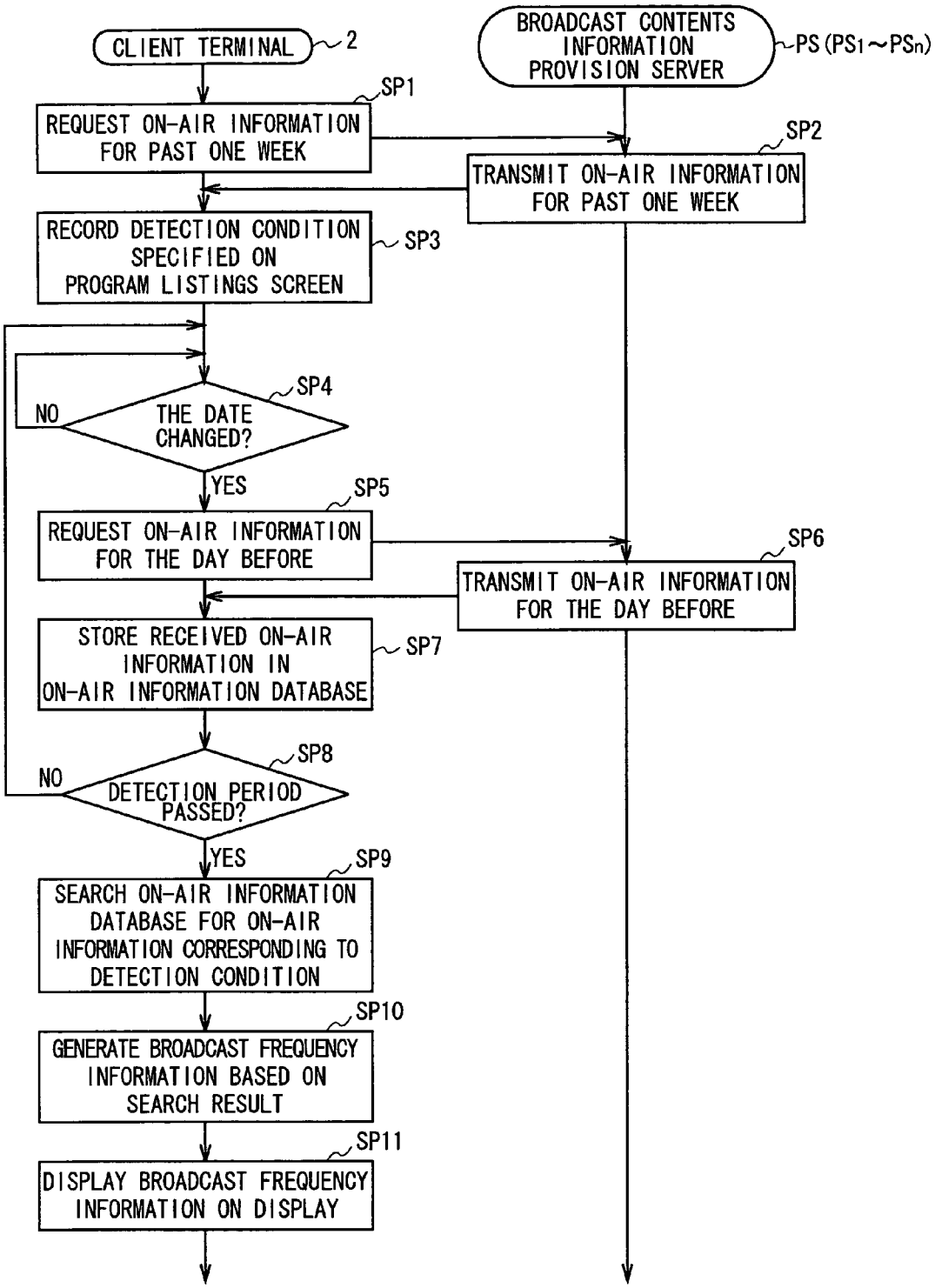
FIG. 9 is a flowchart showing first broadcast frequency display processing.

(4-1) First Broadcast Frequency Display Processing in the Case where the Client Terminal 2 Receives on-Air Information from the Broadcast Contents Information Provision Server PS ($PS_1$-$PS_n$) and Detects the Broadcast Frequency of a Musical Composition As shown in FIG. 9, the first broadcast frequency display processing is formed by a processing sequence by the client terminal 2 and the broadcast contents information provision server PS ($PS_1$-$PS_n$). The processing sequence will be described.

For example, if the power is turned on for the first time, at step SP1, the client terminal 2 requests on-air information for the past one week (Monday to Sunday) from each of the addresses of the broadcast contents information provision servers PS ($PS_1$-$PS_n$) that have been recorded as preset information.

At step SP2, each of the broadcast contents information provision servers PS ($PS_1$-$PS_n$) that was requested the on-air information for the past one week from the client terminal 2 respectively searches the broadcast contents information database 14 for the on-air information for the past one week, and transmits the on-air information for the past one week obtained as the search result to the client terminal 2.

Figure 10:
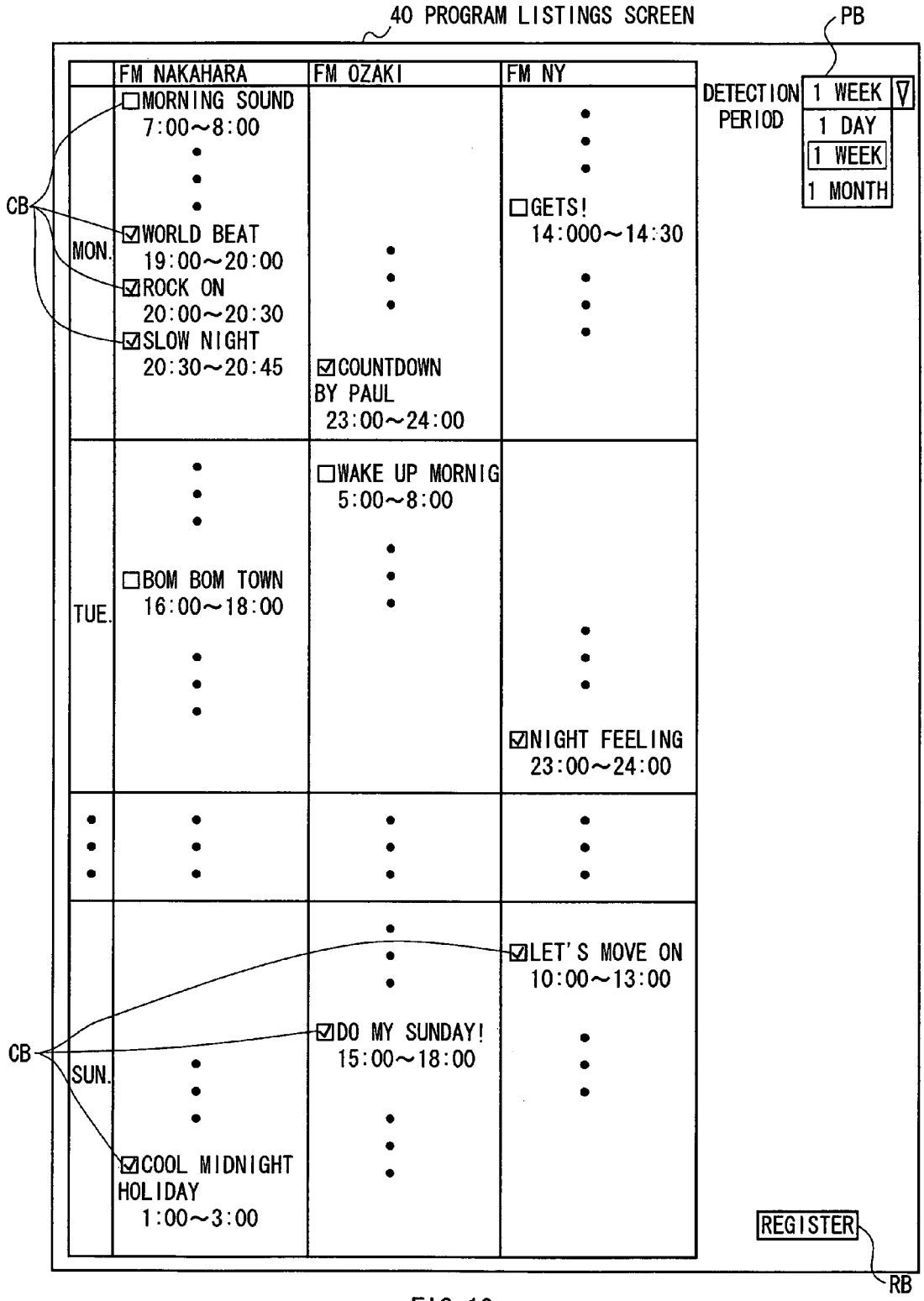
FIG. 10 is a schematic diagram showing a program listings screen.

If receiving the on-air information for the past one week transmitted from each broadcast contents information provision server PS ($PS_1$-$PS_n$), at step SP3, the client terminal 2 generates the program listings of each preset radio station RS ($RS_1$-$RS_n$) based on this on-air information for the past one week, and displays this on the display 26 as a program listings screen 40, as shown in FIG. 10.

This program listings screen 40 is to specify a condition when in detecting the broadcast frequency of a musical composition (hereinafter, this is referred to as a detection condition). As a detection condition, the title of a radio program and a detection period can be specified.

That is, in this program listings screen 40, the titles of the radio programs that were broadcasted in the past one week by one or more preset radio stations RS ($RS_1$-$RS_n$) are displayed by connecting with its broadcasting date, the start time and the end time of the broadcasting. Further, at the left side of the display position of each title, a check box CB is provided.

Thereby, the user can specify the title of a radio program to be a detection condition, by selecting the check box CB of the desired program title by a cursor not shown in the drawings that can be operated by the operation input section 20.

Further, in the program listings screen 40, a selection box PB to specify a detection period is provided. In this selection box PB, as detection periods, for example, "one day", "one week" and "one month" are displayed.

Thereby, the user can specify a detection period to be a detection condition, by selecting a desired detection period from among the detection periods displayed in this selection box PB, "one day", "one week" and "one month".

In this manner, in the client terminal 2, a detection period and the title of a radio program to be detection conditions can be specified on this program listings screen 40. Thereby, for example, detection processing on the broadcast frequency of a musical composition broadcasted in a radio program that does not completely match to the user's preference can be omitted.

In the state where the detection condition has been specified, if recognizing that a registration button RB on the program listings screen 40 was depressed, the client terminal 2 records the specified detection condition on the hard disk drive 31 as detection condition information, and proceeds to the next step SP4.

At step SP4, the client terminal 2 awaits until the date changes, based on a clock circuit (not shown) built in itself. If recognizing that the date changed, the client terminal 2 proceeds to the next step SP5.

At step SP5, the client terminal 2 requests on-air information for the day before from each of the addresses of the broadcast contents information provision servers PS ($PS_1$-$PS_n$) recorded as preset information.

At step SP6, each broadcast contents information provision server PS ($PS_1$-$PS_n$) which was requested the on-air information for the day before from the client terminal 2 respectively searches the broadcast contents information database 14 for the on-air information for the day before, and transmits the on-air information for the day before obtained as the search result to the client terminal 2.

If receiving the on-air information for the day before respectively transmitted from each broadcast contents information provision server PS ($PS_1$-$PS_n$), at step SP7, the client terminal 2 stores this in an on-air information database previously constructed in the hard disk drive 31, and proceeds to the next step SP8. As a result, in this on-air information database, the on-air information of each radio station RS ($RS_1$-$RS_n$) is stored.

At step SP8, the client terminal 2 determines whether or not the detection period (for example, "one week") passed from when the client terminal 2 first recognized that the date changed at step SP4. If obtaining a negative result here, the client terminal 2 returns to step SP4 to await until the date changes again. If recognizing that the date changed, the client terminal 2 requests on-air information for the day before from each broadcast contents information provision server PS ($PS_1$-$PS_n$).

In this manner, the client terminal 2 receives the on-air information for the day before every one day, until an affirmative result is obtained at this step SP8, that is, an acquisition period "one week" passes, and stores this in the on-air information database. Thereby, the on-air information for the detection period "one week" can be stored in the on-air information database.

Then, if obtaining an affirmative result at this step SP8, the client terminal 2 stops receiving the on-air information, and proceeds to step SP9.

At step SP9, the client terminal 2 searches the on-air information database for on-air information corresponding to the title of the radio program that has been recorded as the detection condition information, and proceeds to the next step SP10.

At step SP10, the client terminal 2 groups the on-air information obtained as the search result at step SP9 by the titles of musical compositions, and totalizes the grouped number (that is, the number of times of broadcasting showing the broadcast frequency by the titles of the musical compositions) by the above titles of the musical compositions.

Then, the client terminal 2 generates information in that the title of a musical composition, the artist name of the above musical composition, and the above number of times of broadcasting of the above musical composition are respectively connected with each other (hereinafter, this is referred to as broadcast frequency information), based on the obtained on-air information, and proceeds to the next step SP11.

If the display of broadcast frequency is requested via the operation input section 20, at step SP11, as shown in FIG. 11, the client terminal 2 displays a broadcast frequency display screen 50 showing broadcast frequency information on the display 26.

In this broadcast frequency display screen 50, the broadcast frequency information of the top ten musical compositions of which the number of times of broadcasting was the largest is displayed in descending order of the number of times of broadcasting. Thereby, the user can recognize that which musical composition by which artist is a musical composition frequently broadcasted lately.

Also in after this step SP11, by making the user specify a detection condition again, the broadcast frequency of a musical composition may be detected based on the above detection condition and may be displayed every time.

In this manner, in this first broadcast frequency display processing, the client terminal 2 receives on-air information from the broadcast contents information provision server PS ($PS_1$-$PS_n$) detects the number of times of broadcasting of each musical composition based on the above on-air information, generates broadcast frequency information, and displays this on the display 26. Thereby, the user can recognize that which musical composition is frequently broadcasted.

Figure 12:
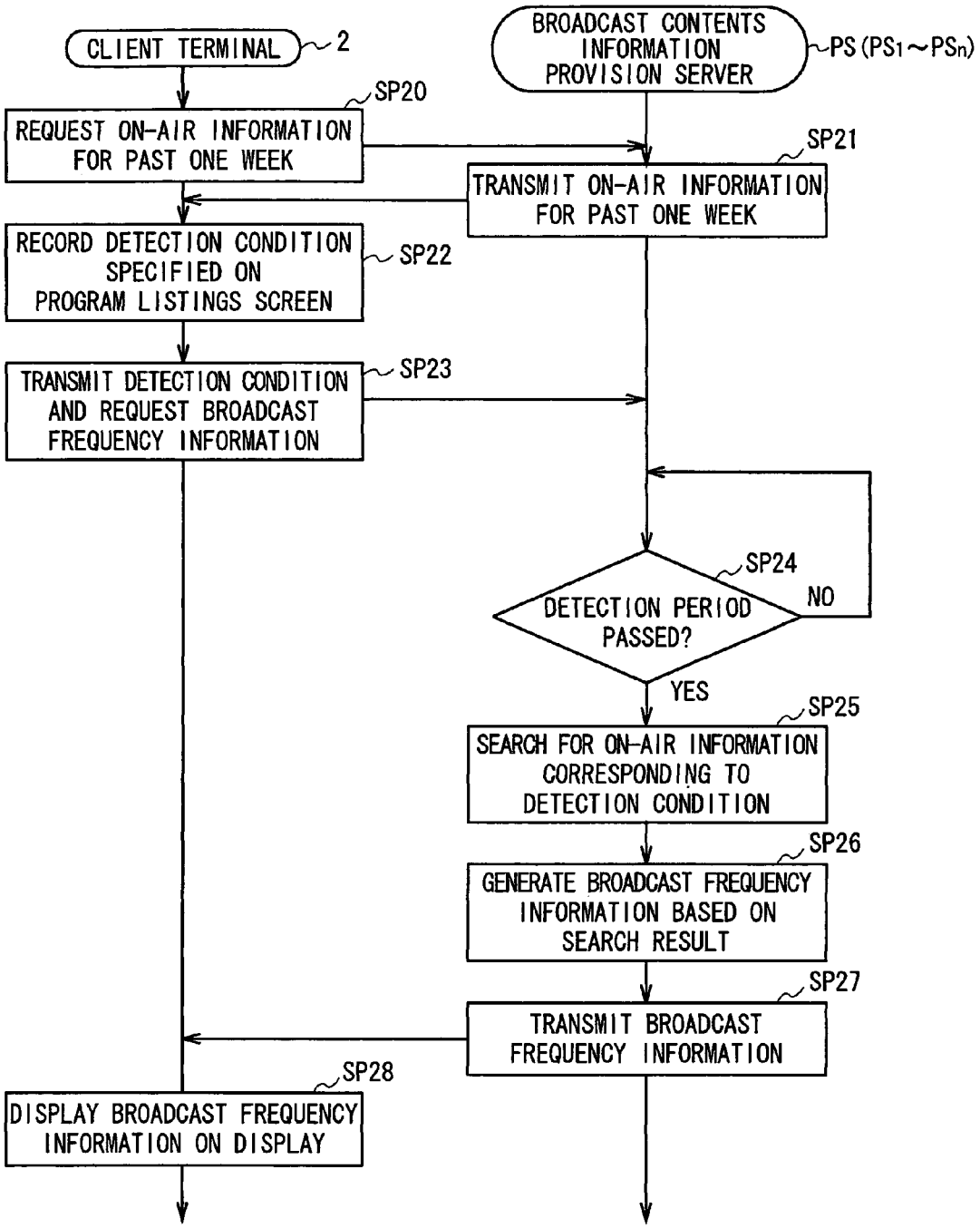
FIG. 12 is a flowchart showing second broadcast frequency display processing.

(4-2) Second Broadcast Frequency Display Processing in the Case where the Broadcast Frequency of a Musical Composition is Detected from on-Air Information on the Broadcast Contents Information Provision Server PS ($PS_1$-$PS_n$) Side and the Client Terminal 2 Receives this As shown in FIG. 12, the second broadcast frequency display processing is formed by a processing sequence by the client terminal 2 and the broadcast contents information provision server PS ($PS_1$-$PS_n$). The processing sequence will be described.

For example, if the power is turned on for the first time, at step SP20, the client terminal 2 requests on-air information for the past one week (Monday to Sunday) from each of the addresses of the broadcast contents information provision servers PS ($PS_1$-$PS_n$) that have been recorded as preset information.

At step SP21, each broadcast contents information provision server PS ($PS_1$-$PS_n$) which was requested the on-air information for the past one week from the client terminal 2 respectively searches the broadcast contents information database 14 for the on-air information for the past one week, and transmits the on-air information for the past one week obtained as the search result to the client terminal 2.

If receiving the on-air information for the past one week transmitted from each broadcast contents information provision server PS ($PS_1$-$PS_n$), at step SP22, the client terminal 2 generates the program listings of each preset radio station RS ($RS_1$-$RS_n$) based on the on-air information for the past one week, and displays this on the display 26 as the program listings screen 40 (FIG. 10).

If a detection period (for example, "one week") and the title of a radio program as detection conditions are specified on this program listings screen 40, similarly to the case of the first broadcast frequency display processing, the client terminal 2 records this on the hard disk drive 31 as detection condition information, and proceeds to the next step SP23.

At step SP23, the client terminal 2 transmits this detection condition information to each of the addresses of the broadcast contents information provision servers PS ($PS_1$-$PS_n$) that have been recorded as preset information, and also requests broadcast contents information.

At step SP24, each broadcast contents information provision server PS ($PS_1$-$PS_n$) that received the detection condition information transmitted from the client terminal 2 and was requested the broadcast frequency information awaits until the detection period in the detection condition information "one week" passes, based on the clock circuit (not shown) built in itself respectively, and if recognizing that the detection period "one week" passed, it proceeds to the next step SP25. In this case, each broadcast contents information provision server PS ($PS_1$-$PS_n$) awaits for example, until one week passes from the next day of the day when it received the detection condition information.

At step SP25, each broadcast contents information provision server PS ($PS_1$-$PS_n$) searches the broadcast contents information database 14 for on-air information corresponding to the title of the specified radio program that was broadcasted in the past one week, based on the detection period "one week" and the title of the radio program specified as the detection condition information, and proceeds to the next step SP26.

At step SP26, each broadcast contents information provision server PS ($PS_1$-$PS_n$) groups the on-air information that was obtained as the search result at step SP25 by the titles of musical compositions, and totalizes the grouped number (the number of times of broadcasting) by the above titles of the musical compositions.

Then, each broadcast contents information provision server PS ($PS_1$-$PS_n$) generates broadcast frequency information in that the title of a musical composition, the artist name of the above musical composition, and the number of times of broadcasting of the above musical composition are respectively connected with each other, based on the obtained on-air information, and proceeds to the next step SP27.

At step SP27, each broadcast contents information provision server PS ($PS_1$-$PS_n$) transmits the generated broadcast frequency information to the client terminal 2 respectively.

After the client terminal 2 received the broadcast frequency information respectively transmitted from each broadcast contents information provision server PS ($PS_1$-$PS_n$), at step SP28, if the display of broadcast frequency is requested via the operation input section 20, the client terminal 2 displays a broadcast frequency display screen 50 (FIG. 11) on the display 26, similarly to the case of the first broadcast frequency display processing.

Note that, in the broadcast frequency information that was respectively transmitted from each broadcast contents information provision server PS ($PS_1$-$PS_n$) at this time, if there are a plurality of musical compositions having the same title, the client terminal 2 totalizes the number of times of broadcasting of them.

In this manner, in this second broadcast frequency display processing, the client terminal 2 makes the broadcast contents information provision server PS ($PS_1$-$PS_n$) side detect the number of times of broadcasting of each musical composition based on the on-air information and generate broadcast frequency information, and receives and displays this on the display 26. Thereby, the user can recognize that which musical composition is frequently broadcasted.

Figure 13:
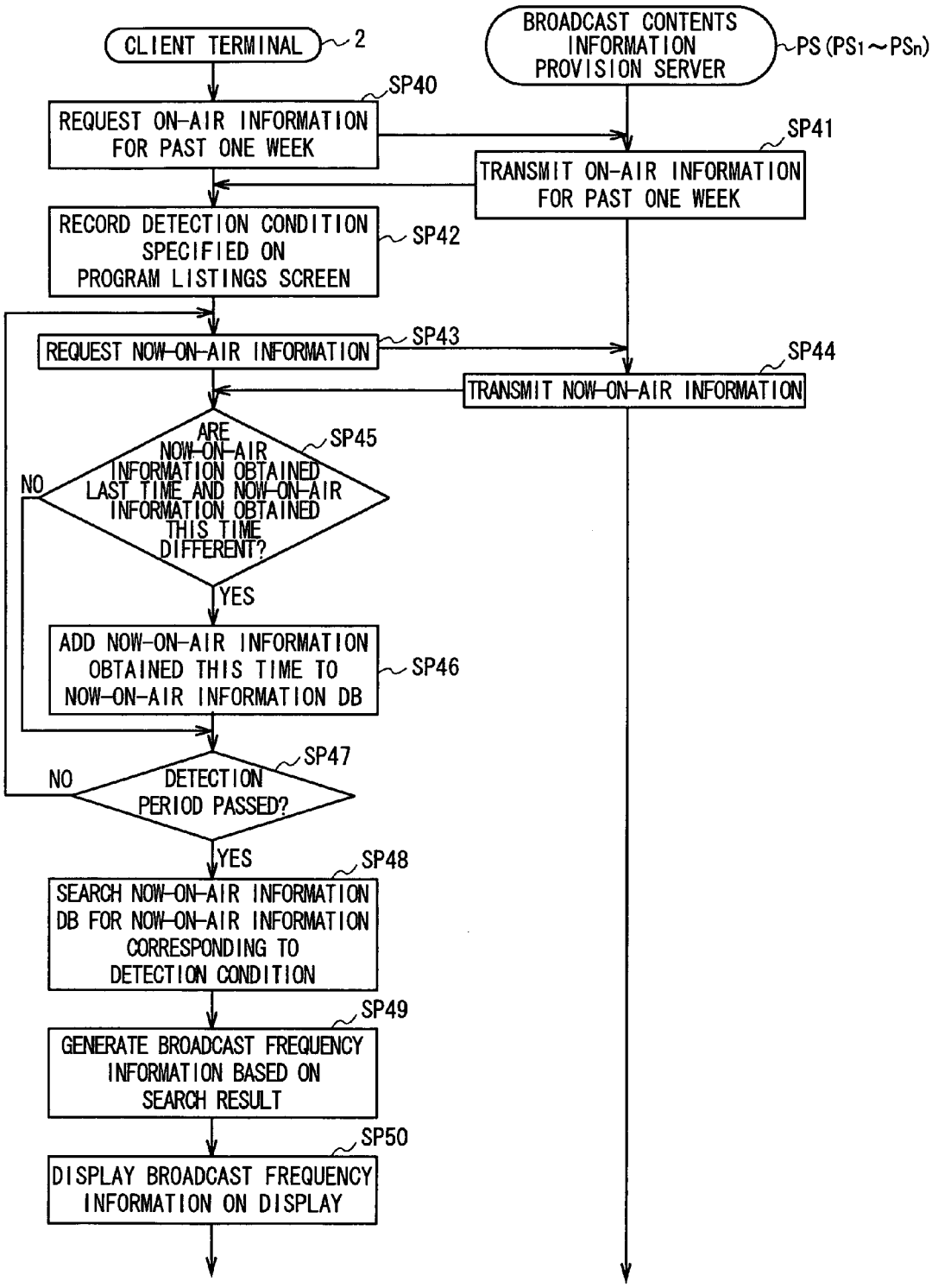
FIG. 13 is a flowchart showing third broadcast frequency display processing.

(4-3) Third Broadcast Frequency Display Processing in the Case where the Client Terminal 2 Detects the Broadcast Frequency of a Musical Composition from Now-on-Air Information As shown in FIG. 13, the third broadcast frequency display processing is formed by a processing sequence by the client terminal 2 and the broadcast contents information provision server PS ($PS_1$-$PS_n$). The processing sequence will be described.

Note that, in order to always obtain the latest now-on-air information, the client terminal 2 makes the acquisition request of now-on-air information to each broadcast contents information provision server PS ($PS_1$-$PS_n$) every predetermined interval (hereinafter, this is referred to as a polling interval, and is set to for example 30 seconds).

For example, if the power is turned on for the first time, at step SP40, the client terminal 2 requests on-air information for the past one week (Monday to Sunday) from each of the addresses of the broadcast contents information provision servers PS ($PS_1$-$PS_n$) that have been recorded as preset information.

At step SP41, each of the broadcast contents information provision servers PS ($PS_1$-$PS_n$) that was requested the on-air information for the past one week from the client terminal 2 respectively searches the broadcast contents information database 14 for the on-air information for the past one week, and transmits the on-air information for the past one week obtained as the search result to the client terminal 2.

If receiving the on-air information for the past one week transmitted from each broadcast contents information provision server PS ($PS_1$-$PS_n$), at step SP42, the client terminal 2 generates the program listings of each preset radio station RS ($RS_1$-$RS_n$) based on this on-air information for the past one week, and displays this on the display 26 as the program listings screen 40 (FIG. 10).

If a detection period (for example, "one week") and the title of a radio program as detection conditions are specified on the program listings screen 40, similarly to the cases of the first and the second broadcast frequency display processing, the client terminal 2 records this on the hard disk drive 31 as detection condition information, and proceeds to the next step SP43.

At step SP43, the client terminal 2 requests now-on-air information from each of the addresses of the broadcast contents information provision servers PS ($PS_1$-$PS_n$) recorded as preset information.

At step SP44, each broadcast contents information provision server PS ($PS_1$-$PS_n$) that was requested now-on-air information from the client terminal 2 extracts the now-on-air information from the table of program being broadcasted TB1 in the broadcast contents information database 14 respectively, and transmits this to the client terminal 2.

If receiving the now-on-air information respectively transmitted from each broadcast contents information provision server PS ($PS_1$-$PS_n$), at step SP45, the client terminal 2 compares the received now-on-air information with the now-on-air information that was received from each broadcast contents information provision server PS ($PS_1$-$PS_n$) at the last time, and determines whether or not they are different.

Specifically, the client terminal 2 compares the now-on-air information received at this time with the now-on-air information received at the last time by the broadcast contents information provision servers PS ($PS_1$-$PS_n$). For instance, the client terminal 2 compares the now-on-air information that was received at this time from the broadcast contents information provision server $PS_1$ with the now-on-air information that was received at the last time from the above broadcast contents information provision server $PS_1$.

If a negative result is obtained here, this means that for example, in the radio station $RS_1$ corresponding to the broadcast contents information provision server $PS_1$, the musical composition being broadcasted has not been switched between the present time and the last time (30 seconds ago), and the now-on-air information at the last time and this time are the same. At this time, the client terminal 2 proceeds to step SP47.

On the contrary, if an affirmative result is obtained at this step SP45, this means that for example, in the radio station $RS_1$ corresponding to the broadcast contents information provision server $PS_1$, the musical composition was switched between the present time and the last time (30 seconds ago), so that the now-on-air information at the last time and the now-on-air information at this time are different. At this time, the client terminal 2 proceeds to step SP46.

At step SP46, the client terminal 2 adds the now-on-air information obtained at this time to a now-on-air information database previously constructed in the hard disk drive 31, by connecting with the time of this time, and proceeds to the next step SP47.

In this manner, in the client terminal 2, the now-on-air information received from each broadcast contents information provision server PS ($PS_1$-$PS_n$) is compared with the now-on-air information received from each broadcast contents information provision server PS ($PS_1$-$PS_n$) at the last time respectively, and only when they are different (that is, the musical composition was switched), the now-on-air information is added and stored in the now-on-air information database.

That is, in the now-on-air information database, now-on-air information concerning the radio programs and the musical compositions that were broadcasted by each radio station RS ($RS_1$-$RS_n$) is stored. As a result, in the now-on-air information database, information almost equal to the aforementioned on-air information database is stored.

Therefore, the now-on-air information stored in this now-on-air information database becomes a list showing that which musical composition was broadcasted in which radio program.

At step SP47, the client terminal 2 determines whether or not a detection period (for example, "one week") passed from when the client terminal 2 first requested now-on-air information at step SP43. If obtaining a negative result here, the client terminal 2 returns to step SP43 after the polling interval "30 seconds" passed, and requests now-on-air information from each broadcast contents information provision server PS ($PS_1$-$PS_n$) again.

In this manner, the client terminal 2 requests and receives now-on-air information every polling interval "30 seconds" until an affirmative is obtained at this step SP47, that is, the acquisition period "one week" passes, and stores the now-on-air information in the now-on-air information database only when the above now-on-air information is different from the now-on-air information received at the last time.

Then, if obtaining an affirmative result at this step SP47, the client terminal 2 stops receiving now-on-air information, and proceeds to step SP48.

At step SP48, the client terminal 2 searches the now-on-air information database for now-on-air information corresponding to the title of the radio program that was recorded as detection condition information, and proceeds to the next step SP49.

At step SP49, the client terminal 2 groups the now-on-air information obtained as the search result at step SP48 by the titles of musical compositions, and totalizes the grouped number (the number of times of broadcasting) by the above titles of the musical compositions.

Then, the client terminal 2 generates broadcast frequency information in that the title of a musical composition, the artist name of the above musical composition, and the number of times of broadcasting of the above musical composition are respectively connected with each other, based on the obtained now-on-air information, and proceeds to the next step SP50.

If the display of broadcast frequency is requested via the operation input section 20, at step SP50, the client terminal 2 outputs a broadcast frequency display screen 50 (FIG. 11) from the display 26, similarly to the cases of the first and the second broadcast frequency display processing.

In this manner, in the third broadcast frequency display processing, the client terminal 2 receives now-on-air information from the broadcast contents information provision server PS ($PS_1$-$PS_n$), detects the number of times of broadcasting of each musical composition based the above now-on-air information, generates broadcast frequency information, and outputs this from the display 26. Thereby, the user can recognize that which musical composition is frequently broadcasted.

(5) Operation and Effect of This Embodiment

According to the above configuration, the client terminal 2 makes the user specify a detection period and the title of a radio program as detection conditions when in detecting the broadcast frequency of a musical composition, and registers them.

Then, the client terminal 2 receives on-air information for the detection period from the broadcast contents information provision servers PS ($PS_1$-$PS_n$) of which the addresses have been registered as preset information, and stores this in the on-air information database.

The client terminal 2 searches the on-air information database for on-air information corresponding to the specified title of the radio program, groups this by the titles of musical compositions and totalizes the number of times of broadcasting of each musical composition, and generates broadcast frequency information based on the above number of times of broadcasting and displays this.

Thereby, the client terminal 2 can make the user recognize that which musical composition is frequently broadcasted.

Also, the client terminal 2 transmits detection condition information showing a search condition to the broadcast contents information provision servers PS ($PS_1$-$PS_n$) of which the addresses have been registered as preset information, and receives broadcast frequency information generated by each broadcast contents information provision server PS ($PS_1$-$PS_n$) based on this.

In this case, each broadcast contents information provision server PS ($PS_1$-$PS_n$) searches the broadcast contents information database 14 for on-air information corresponding to the specified title of the radio program that was broadcasted in the detection period, based on the search condition information transmitted from the client terminal 2, generates broadcast frequency information based on the search result, and transmits this to the client terminal 2.

Thereby, processing on the client terminal 2 side can be reduced. Further, that the user of the client terminal 2 likes what radio programs can be recognized in each broadcast contents information provision server PS ($PS_1$-$PS_n$).

Furthermore, the client terminal 2 also receives now-on-air information concerning the radio broadcasting being broadcasted, from each broadcast contents information provision server PS ($PS_1$-$PS_n$), instead of the on-air information concerning the radio broadcasting that was already broadcasted, stores this, and generates broadcast frequency information based on the stored now-on-air information.

According to the above configuration, by detecting the broadcast frequency of a musical composition in radio broadcasting based on on-air information and now-on-air information being broadcast contents information, the client terminal 2 can display the broadcast frequency of each musical composition on the display 26 without receiving and outputting the radio broadcasting. Thereby, the user can recognize that which musical composition is frequently broadcasted. Thus, the broadcast frequency of a musical composition can be shown to the above user, even if the user is not listening to the musical composition broadcasted in the radio broadcasting.

Further, the client terminal 2 displays the ranking of the top ten musical compositions of which the number of times of broadcasting is the largest on the display 26 to show it to the user. Thereby, the above user can easily recognize that which musical composition is frequently broadcasted.

(6) Other Embodiments

In the aforementioned embodiment, it has dealt with the case where musical compositions being broadcast contents broadcasted in radio broadcasting are set as the detection object of broadcast frequency. However, the present invention is not only limited to this but also various broadcast contents other than this, such as images broadcasted in television broadcasting and Internet broadcasting, may be set as the detection object of broadcast frequency.

In the aforementioned embodiment, it has dealt with the case where respectively-corresponding broadcast contents information provision server PS ($PS_1$-$PS_n$) is connected to each radio station RS ($RS_1$-$RS_n$), and each broadcast contents information provision server PS ($PS_1$-$PS_n$) records and manages the broadcast contents information of the radio broadcasting broadcasted by respectively-corresponding radio station RS ($RS_1$-$RS_n$). However, the present invention is not only limited to this but also the broadcast contents information of the radio broadcasting broadcasted by all of the radio stations RS ($RS_1$-$RS_n$) may be recorded and managed in a lump, for example, by one broadcast contents information provision server connected to the all of the radio stations RS ($RS_1$-$RS_n$).

Further, in the aforementioned embodiment, it has dealt with the case where in the table of already-broadcasted musical compositions TB2 and the table of already-broadcasted programs TB3 to be the source of on-air information, broadcast contents information concerning the radio programs that were broadcasted in the past and the musical compositions that were broadcasted in the above radio program are stored. However, the present invention is not only limited to this but also for example, broadcast contents information concerning the radio programs that are scheduled to be broadcasted and the musical compositions that are scheduled to be broadcasted in the above radio programs for several weeks may be previously stored. Thereby, for example, a radio program scheduled to be broadcasted can be specified as a detection condition. Further, it is also possible to detect the scheduled number of times of broadcasting of each musical composition.

Further, in the aforementioned embodiment, it has dealt with the case where the broadcast frequency of a musical composition in radio broadcasting is detected based on on-air information and now-on-air information being broadcast contents information that has been stored or recorded in each broadcast contents information provision server PS ($PS_1$-$PS_n$). However, the present invention is not only limited to this but also provided that it is broadcast contents information including information that can specify the broadcast frequency of a musical composition, broadcast frequency may be detected from various broadcast contents information other than this.

Further, in the aforementioned embodiment, it has dealt with the case where a detection period is selected for example from among "one day", "one week" and "one month", and the broadcast frequency of a musical composition in the detection period is detected and displayed. However, the present invention is not only limited to this but also by automatically respectively detecting the broadcast frequency of a musical composition for example every one day, one week and one month and storing this, the broadcast frequency of a predetermined period may be properly displayed responding to a request from the user. Thereby, for example, the user can refer to the history of the broadcast frequency that was stored every one week, and the user also can recognize the tendency of the broadcast frequency of a musical composition.

Further, in the aforementioned embodiment, it has dealt with the case where the acquisition period of on-air information and now-on-air information (that is, the broadcasting period of a musical composition), the title of a radio program, and the addresses (or the broadcasting station names) of the broadcast contents information provision servers PS ($PS_1$-$PS_n$) that have been registered as preset information are set as detection conditions as the search conditions of a musical composition. However, the present invention is not only limited to this but also various information included in on-air information and now-on-air information may be set as search conditions. In this case, for example, by making the user specify a desired genre as a search condition and showing the broadcast frequency of musical compositions in this specified genre, the above user also can recognize that which musical composition is frequently broadcasted among the musical compositions in the genre matching to the user's preference.

Further, in the aforementioned embodiment, it has dealt with the case where the client terminal 2 serving as a broadcast frequency detection system, an external device and an information processing unit is composed of the operation input section 20 and the input processing section 21 that serve as search condition setting means, the communication processing section 34 and the network interface 35 that serve as communication means, and the CPU 23 serving as detection means. However, the present invention is not only limited to this but also the client terminal 2 may be formed by various configurations other than this.

Further, in the aforementioned embodiment, it has dealt with the case where the broadcast contents information provision server PS ($PS_1$-$PS_n$) serving as a broadcast frequency detection system, a storage device and an information processing unit is composed of the broadcast contents information database 14 serving as a storage medium, the communication processing section 16 and the network interface 17 that serve as receiving means and transmission means, and the control section 10 serving as search means and detection means. However, the present invention is not only limited to this but also the broadcast contents information provision server PS ($PS_1$-$PS_n$) may be formed by various configurations other than this.

Further, in the aforementioned embodiment, radio broadcasting broadcasted by radio stations is applied to the broadcasting that can be received by the client terminal 2. However, the present invention is not only limited to this but also the client terminal 2 may receive Internet radio broadcasting and satellite radio broadcasting and obtain its broadcast contents information, or may receive television broadcasting broadcasted by television broadcasting stations and obtain various broadcast contents information concerning the television programs in the television broadcasting or the like from a server on the network.

Further, in the aforementioned embodiment, it has dealt with the case where the control section 10 of the broadcast contents information provision server PS ($PS_1$-$PS_n$) and the CPU 23 of the client terminal 2 execute the aforementioned broadcast frequency display processing, based on programs previously stored in the ROM 11 and the ROM 24. However, the present invention is not only limited to this but also for example, a module dedicated to the broadcast frequency display processing may be packaged in the broadcast contents information provision server PS ($PS_1$-$PS_n$) and the client terminal 2, and this module may execute the broadcast frequency display processing in place of the control section 10 and the CPU 23.

Further, in the aforementioned embodiment, it has dealt with the case where the present invention is applied to the client terminal 2 being a receiving device of radio broadcasting. However, the present invention is not only limited to this but also may be applied to various terminals other than the client terminal 2, such as a cellular phone and a personal computer. Moreover, in this case, for example, if the aforementioned module dedicated to the broadcast frequency display processing is packaged in these various terminals, processing similar to the client terminal 2 can be easily realized.

INDUSTRIAL APPLICABILITY

The present invention can be widely used to a receiving system for receiving broadcast contents or the like.

The invention claimed is:

1. An apparatus comprising:

a determining unit configured to determine if a condition relative to a predetermined time period is met;

a communication unit configured to automatically transmit to a server a request for obtaining a number of times contents will be broadcasted during a future time period when the condition relative to the predetermined time period is met, and to receive the number of times contents will be broadcasted during a future time period from said server as a response to the request; and a display configured to display a ranking of the contents such that the number of times contents will be broadcasted during the future time period is displayed next to a title of each content, and a content with a highest number of times to be broadcasted is displayed at a top of the ranking.

2. The apparatus according to claim 1, further comprising:

a display processing unit configured to process data to be displayed on the display unit, said display processing unit configured to display the number of times contents will be broadcasted during a future time period on the display unit in a predetermined order.

3. The apparatus according to claim 1, further comprising:

a setting unit configured to set at least one of a broadcasting period, a title, and a broadcasting station as a search condition, said communication unit configured to transmit said search condition to said server, and the number of times contents will be broadcasted during a future time period is searched based on the search condition at the server and is received by said communication unit.

4. The apparatus according to claim 1, wherein said predetermined time period can be changed by a user.

5. The apparatus according to claim 1, wherein said determining unit determines the condition is met each time an amount of time equal to the predetermined time period elapses.

6. A system comprising:

a storage unit configured to store broadcast contents information including the broadcasting time or date, and titles of the broadcast contents;

a communication unit configured to receive from an external device a request for obtaining a number of times contents will be broadcasted during a future time period and a search condition including at least one of a broadcasting period, a title, and a broadcasting station, said communication unit configured to transmit to said external device the information representing the number of times contents will be broadcasted during a future time period as a response to the request;

a controller configured to search said storage unit and to generate information representing said number of times contents will be broadcasted during a future time period based on said received search condition; and a display configured to display a ranking of the contents such that the number of times contents will be broadcasted during the future time period is displayed next to a title of each content, and a content with a highest number of times to be broadcasted is displayed at a top of the ranking.

7. The system according to claim 6, wherein said communication unit receives said request from said external device at predetermined time intervals.

8. The system according to claim 7, wherein said communication unit receives said request from said external device at one day time intervals.

9. A method comprising:

automatically transmitting request information to request broadcast contents information to a storage device configured to store broadcast contents information including the titles of the broadcast contents that will be broadcasted during a future time period by one or more broadcasting stations each time an amount of time equal to a predetermined time period elapses;

receiving the broadcast contents information transmitted from said storage device corresponding to the request information;

detecting a number of times contents will be broadcasted during a future time period included in the broadcast contents information received in said transmitting; and displaying a ranking of the contents such that the number of times contents will be broadcasted during the future time period is displayed next to a title of each content, and a content with a highest number of times to be broadcasted is displayed at a top of the ranking.

10. A method comprising:

storing broadcast contents information including the broadcasting time and date and the titles of the broadcast contents that will be broadcasted during a future time period by one or more broadcasting stations in a storage medium;

receiving search condition information to specify at least one of the title and the broadcasting station name of a broadcast program as a search condition from an external device;

searching said storage medium for broadcast contents information corresponding to said search condition based on said search condition information received in said receiving;

determining a number of times contents will be broadcasted during a future time period in the broadcast contents information that was obtained as the search result in said searching;

transmitting information based on said number of times contents will be broadcasted during a future time period for said broadcast contents detected in said determining to said external device; and displaying a ranking of the contents such that the number of times contents will be broadcasted during the future time period is displayed next to a title of each content, and a content with a highest number of times to be broadcasted is displayed at a top of the ranking.

11. A non-transitory computer readable medium including computer executable instructions, wherein the instructions, when executed by a processor, cause the processor to perform a method comprising:

automatically transmitting request information to request broadcast contents information to a storage device configured to store broadcast contents information including the titles of the broadcast contents that will be broadcasted during a future time period by one or more broadcasting stations each time an amount of time equal to a predetermined time period elapses;

receiving the broadcast contents information transmitted from said storage device corresponding to the request information;

detecting a number of times contents will be broadcasted during a future time period included in the broadcast contents information received in said transmitting; and displaying a ranking of the contents such that the number of times contents will be broadcasted during the future time period is displayed next to a title of each content, and a content with a highest number of times to be broadcasted is displayed at a top of the ranking.

12. A non-transitory computer readable medium including computer executable instructions, wherein the instructions, when executed by a processor, cause the processor to perform a method comprising:

storing broadcast contents information including the broadcasting time and date and the titles of the broadcast contents that will be broadcasted during a future time period by one or more broadcasting stations in a storage medium;

receiving search condition information to specify at least one of the title and the broadcasting station name of a broadcast program as a search condition from an external device;

searching said storage medium for broadcast contents information corresponding to said search condition based on said search condition information received in said receiving;

determining a number of times contents will be broadcasted during a future time period in the broadcast contents information that was obtained as the search result in said searching;

transmitting information based on said number of times contents will be broadcasted during a future time period for said broadcast contents detected in said determining to said external device; and displaying a ranking of the contents such that the number of times contents will be broadcasted during the future time period is displayed next to a title of each content, and a content with a highest number of times to be broadcasted is displayed at a top of the ranking.

13. An apparatus comprising:

determining means for determining if a condition relative to a predetermined time period is met;

communication means for automatically transmitting to a server a request for obtaining a number of times contents will be broadcasted during a future time period when the condition relative to the predetermined time period is met, and receiving the number of times contents will be broadcasted during a future time period from said server as a response to the request; and display means for displaying a ranking of the contents such that the number of times contents will be broadcasted during the future time period is displayed next to a title of each content, and a content with a highest number of times to be broadcasted is displayed at a top of the ranking.

14. A system comprising:

storage means for storing broadcast contents information including the broadcasting time or date, and titles of the broadcast contents;

communication means for receiving from an external device a request for obtaining a number of times contents will be broadcasted during a future time period and a search condition including at least one of a broadcasting period, a title, and a broadcasting station, said communication means transmitting to said external device the information representing the number of times contents will be broadcasted during a future time period as a response to the request;

control means for searching said storage and generating information representing said number of times contents will be broadcasted during a future time period based on said search condition; and display means for displaying a ranking of the contents such that the number of times contents will be broadcasted during the future time period is displayed next to a title of each content, and a content with a highest number of times to be broadcasted is displayed at a top of the ranking.

* * * * *